US007217067B2

(12) United States Patent
Mao et al.

(10) Patent No.: US 7,217,067 B2
(45) Date of Patent: May 15, 2007

(54) RISER KEEL JOINT ASSEMBLY

(75) Inventors: Changshi Mao, Missouri City, TX (US); Robin M. Converse, Houston, TX (US)

(73) Assignee: SparTEC, Inc., Houston, TX (US)

( * ) Notice: Subject to any disclaimer, the term of this patent is extended or adjusted under 35 U.S.C. 154(b) by 31 days.

(21) Appl. No.: 11/214,086

(22) Filed: Aug. 29, 2005

(65) Prior Publication Data

US 2007/0048094 A1 Mar. 1, 2007

(51) Int. Cl.
*E21B 17/01* (2006.01)

(52) U.S. Cl. ..... 405/224.2; 405/224.4

(58) Field of Classification Search ..... 405/224, 405/224.2–224.4

See application file for complete search history.

(56) References Cited

U.S. PATENT DOCUMENTS 5,683,205 A * 11/1997 Halkyard ..... 405/224.2
5,887,659 A * 3/1999 Watkins ..... 405/224.2
6,176,646 B1 * 1/2001 Finn et al. ..... 405/224.2
6,422,791 B1 * 7/2002 Pallini et al. ..... 405/224.2
6,746,182 B2 * 6/2004 Munk et al. ..... 405/224.2
6,884,003 B2 * 4/2005 Horton, III ..... 405/224.2
7,013,824 B2 * 3/2006 Otten et al. ..... 114/264

* cited by examiner

*Primary Examiner*—Frederick L. Lagman
(74) *Attorney, Agent, or Firm*—D. Neil LaHaye; Eric Marich

(57) ABSTRACT

A riser joint keel assembly. A tapered riser joint is connected to a larger diameter outer sleeve through a connection that allows the tapered section and outer sleeve to function as one unit. In the combined design, the outer sleeve provides the required sliding interface between the riser and the guide at the keel of the hull while also providing some of the bending compliance needed to transition from the riser supported in the hull to the riser unsupported below the hull. The tapered section also provides the remaining bending compliance needed for the transition. The connection between the tapered and sleeve sections is a forged, machined ring plate welded to the bottom end of the sleeve, which provides a base for either bolted or threaded type attachment points for the tapered riser joint below the ring plate and the internal riser joint that continues to the surface.

3 Claims, 5 Drawing Sheets

RISER KEEL JOINT ASSEMBLY

BACKGROUND OF THE INVENTION

1. Field of the Invention

The invention is generally related to floating structures offshore for oil and gas production and, more particularly, to a riser keel joint assembly for such structures.

2. General Background

All floating systems used by the Oil and Gas Industry to recover hydrocarbons from seafloor sites in offshore waters have risers of some type connecting the well termination at the seafloor to the floating system at the surface. One particular type of riser, the independently supported, top-tensioned riser, extends vertically from the seafloor to the floating system and is directly supported either by buoyancy modules (cans) or other means (e.g., tensioners) that can support the weight of the riser and accommodate the relative movement between that riser and the floating platform when the platform responds to metocean environments. This type of riser has been used by both Spar platforms and Tension Leg Platforms. Where the platform hull is a mono-column- or these risers pass close by the hull structure, some kind of special section of riser is required at the keel of the hull to accommodate the bending loads where the riser leaves the support of the platform and this section also has to accommodate the relative vertical movement between the riser and the hull.

The special riser joint at the keel of the hull and which is addressed by this invention is commonly referred to as the Keel Joint. This section is reinforced to carry the bending loads imposed on the riser by the pitch/heel motions of the hull relative to the riser as well as the bearing and wear loads imposed on the riser by the vertical and lateral motions of the hull relative to the riser.

The functions of a keel joint are straightforward and include:

Reinforcing the bending capacity of the riser by a significant amount so it can have adequate strength and adequate fatigue life (lower stress ranges).

Permitting the riser pipe to curve compliantly as the hull keel moves horizontally relative to the fixed end of the riser at the seafloor.

Bearing on the guides in the hull both to transfer the load to the hull through the keel joint outer surface, instead of through the riser pipe itself, and to incur the wear from friction forces as the riser slides axially against the guides in the hull.

There are several versions of keel joints in the known art.

One type has a larger diameter sleeve, centralized around the riser pipe and attached directly to it with rubber spacers at each end which are vulcanized to both the riser and the sleeve in the annular space. This type of joint supports the riser at the two locations of the rubber and delivers the lateral load from these two locations through the sleeve to the guide locations(s). The rubber provides the flexibility for the riser itself to rotate. In this version, the keel joint is an integral part of the riser string itself.

Another type has the riser in a sleeve similar to the above type but the sleeve is attached to the riser by bolting at each end. For this purpose, the riser is fabricated with machined bumps and flanges at each end both to attach to the sleeve and to the continuing sections of riser at each end. Riser rotation is limited by the flexibility of the sleeve and the riser pipe itself beyond either end of the sleeve resulting in a rather stiff system in bending.

Another type has the riser centralized in a larger diameter pipe called a stem. The stem is suspended directly from the buoyancy module at the top of the riser. The stem performs the same function as the sleeve in the aforementioned example but in this version the riser is not connected to the stem but only centralized within it using a ball type centralizer that allows the riser to pivot and curve relative to the stem.

SUMMARY OF THE INVENTION

The invention addresses the needs in the known art. What is provided is a tapered riser joint that is connected to a larger diameter outer sleeve through a connection that allows the tapered section and outer sleeve to function as one unit. Working as one unit, fewer and smaller parts are required than when similar pieces are configured to function separately. In the combined design, the outer sleeve provides the required sliding interface between the riser and the guide at the keel of the hull while also providing some of the bending compliance needed to transition from the riser supported in the hull to the riser unsupported below the hull. Also in this design, the tapered section provides the remaining bending compliance needed for the transition.

The connection between the tapered and sleeve sections is a forged, machined ring plate welded to the bottom end of the sleeve which provides a base for either bolted or threaded type attachment points for the tapered riser joint below the ring plate and the internal riser joint that continues to the surface.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 1:
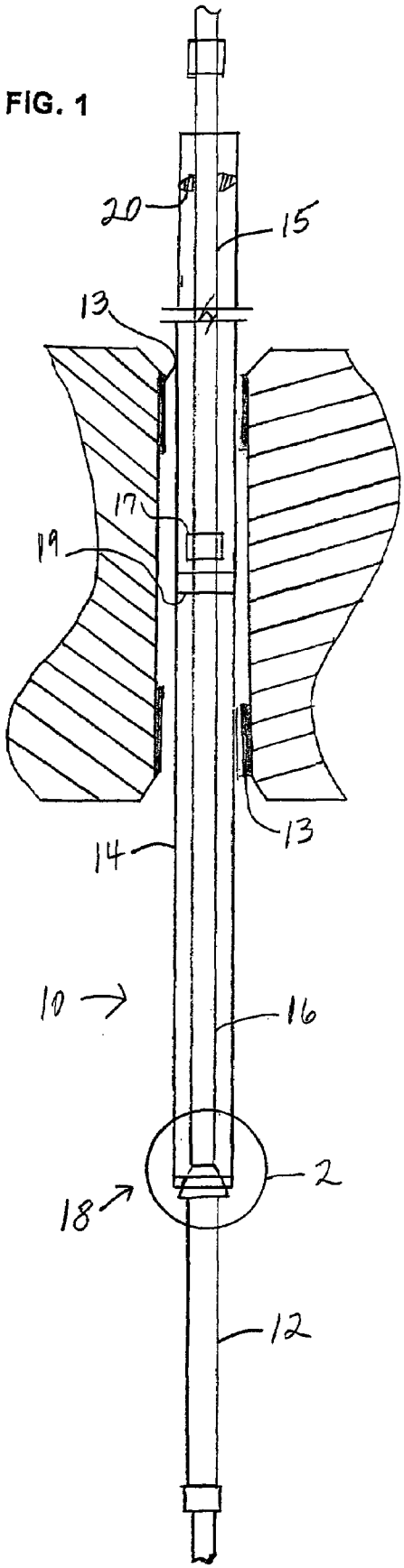
FIG. 1 is an elevation view that illustrates the preferred embodiment of the installed invention.

Referring to the drawings, it is seen in FIG. 1 that the invention is generally indicated by the numeral 10. The riser keel joint assembly 10 is generally comprised of a single tapered riser joint 12, a sleeve 14, and an internal riser joint 16 installed on a floating offshore structure 11.

Tapered riser joint 12 is connected to the sleeve 14 and internal riser joint 16 at a connecting flange 18.

The internal riser joint 16 may be formed from one or more riser joints, depending upon the length of riser required relative to the sleeve 14. When a second internal riser joint 15 is required, a mechanical joint 17 is used to connect the joints 15 and 16. The sleeve 14 may also be extended through the use of a mechanical connector 19 when its total length is over the drilling rig length handling limitations during riser installation. The internal riser joint 16/15 is provided with a centralizer 20 near the upper end of sleeve 14. Mechanical joints and centralizers are generally known in the industry. The sleeve 14 is laterally supported by guides 13 at two elevations in the keel region of the offshore structure 11 so the guides 13 develop a moment resisting couple acting on the sleeve 14.

Figure 2:
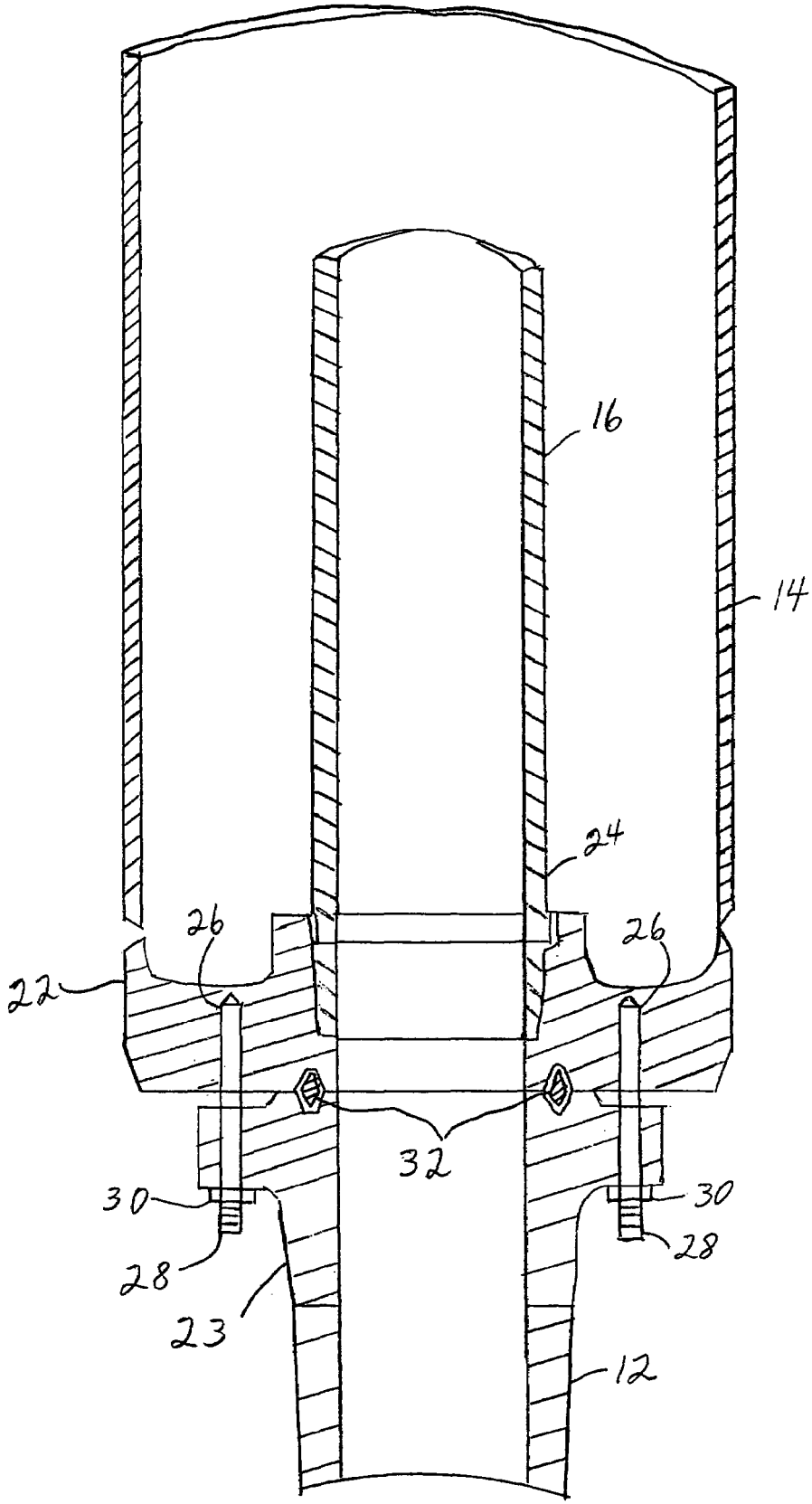
FIG. 2 is a detailed view of the circled area indicated by the number 2 in FIG. 1.

FIG. 2 illustrates the details of the preferred connecting flange 18. A threaded flange 22 is rigidly attached to sleeve 14 by any suitable means such as welding. Flange 22 has a central, threaded bore that is sized to receive the threaded end 24 of internal riser joint 16. Flange 22 is also provided with threaded bores 26 which receive pre-tension bolts 28 when attaching tapered riser joint 12 to the flange 22. Nuts 30 on the pre-tension bolts 28 secure the tapered riser joint 12 in place. Tapered riser joint 12 is provided with a suitable flange 23 such as an API 6A flange at the upper end to accomplish the connection. A gasket 32 is inserted between the flanges to maintain the internal pressure and seal at the connection of the two risers. The gasket 32 is preferably a pressure energized ring gasket. The tapered profile of threaded flange 22 provides the welding access to the outer sleeve 14. The overall shop assembly length, including the tapered riser joint 12 and sleeve 14 is determined by the rig installation capacity. The internal riser joint 16 is readily installed in the sleeve 14 at the offshore location of the structure 11 due to the threaded connection on flange 22. The API 6A flange 23 and tapered riser 12 may be machined from one forged piece. However, welding a standard API 6A flange to the tapered riser joint 12 is more economically efficient. The tapered riser joint 12 and the lower part of the sleeve 14 may be pre-assembled to the flange 22 in the shop while the rest of the parts are installed at the offshore site using a drilling rig.

Figure 3:
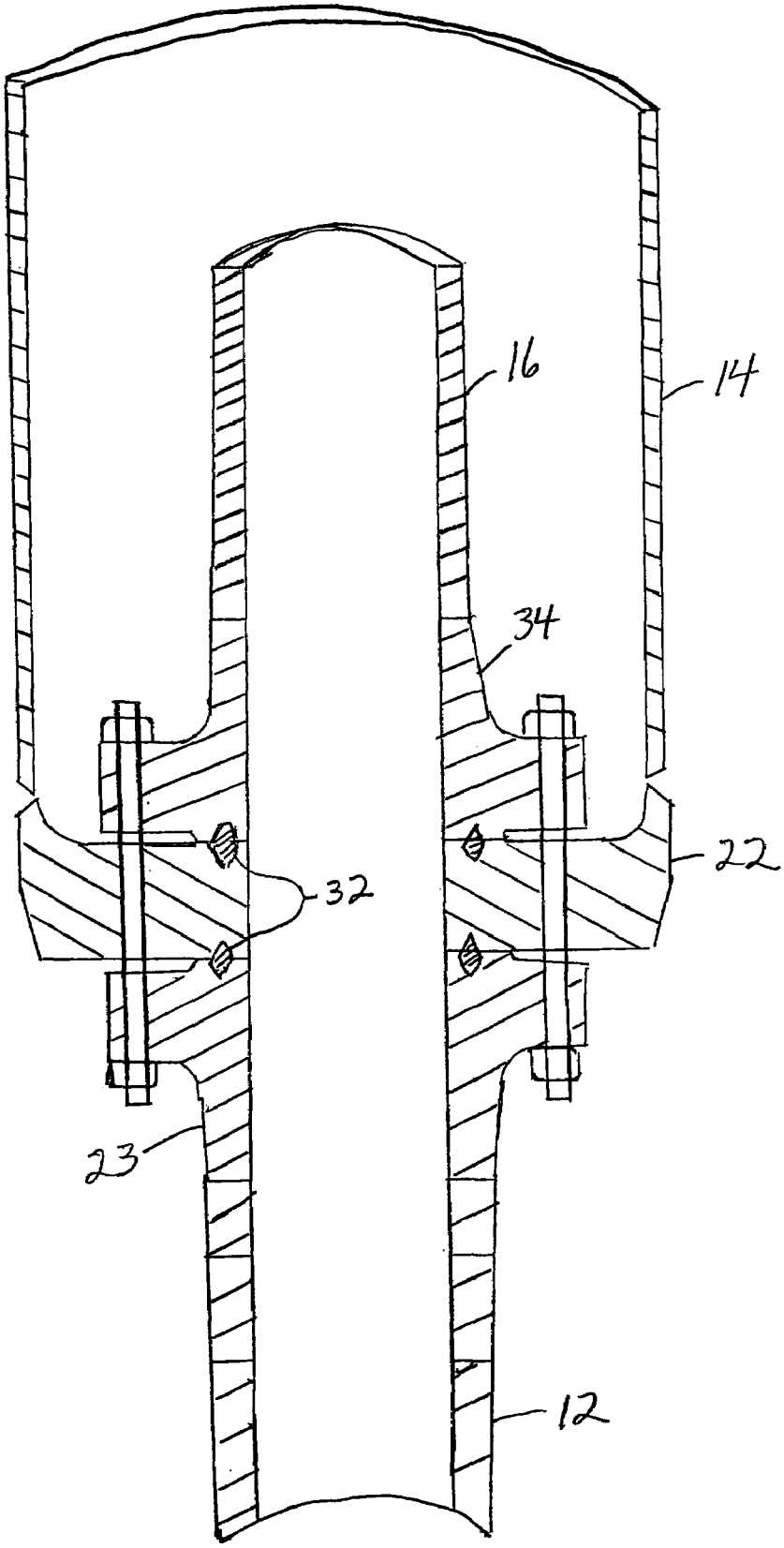
FIG. 3 is an alternate embodiment of the circled area indicated by the number 2 in FIG. 1.

FIG. 3 illustrates an alternate embodiment of the connecting flange 18 arrangement. In this embodiment, the threaded end 24 of the internal riser joint 16 is replaced with an API 6A flange 34 which has the same dimension and profile as the flange 23 on the tapered riser joint 12. This allows easy matching and bolting of both flanges 23 and 34 to threaded flange 22. Each flange 23, 34 is provided with a gasket 32 as described above. Threaded flange 22 provides the same function as an attachment point for the tapered riser joint 12, internal riser joint 16, and sleeve 14. In this embodiment the internal riser joint 16 is pre-assembled in the shop rather than installed offshore. This embodiment has the same function and mechanical behaviors as the embodiment of FIG. 2.

Figure 4:
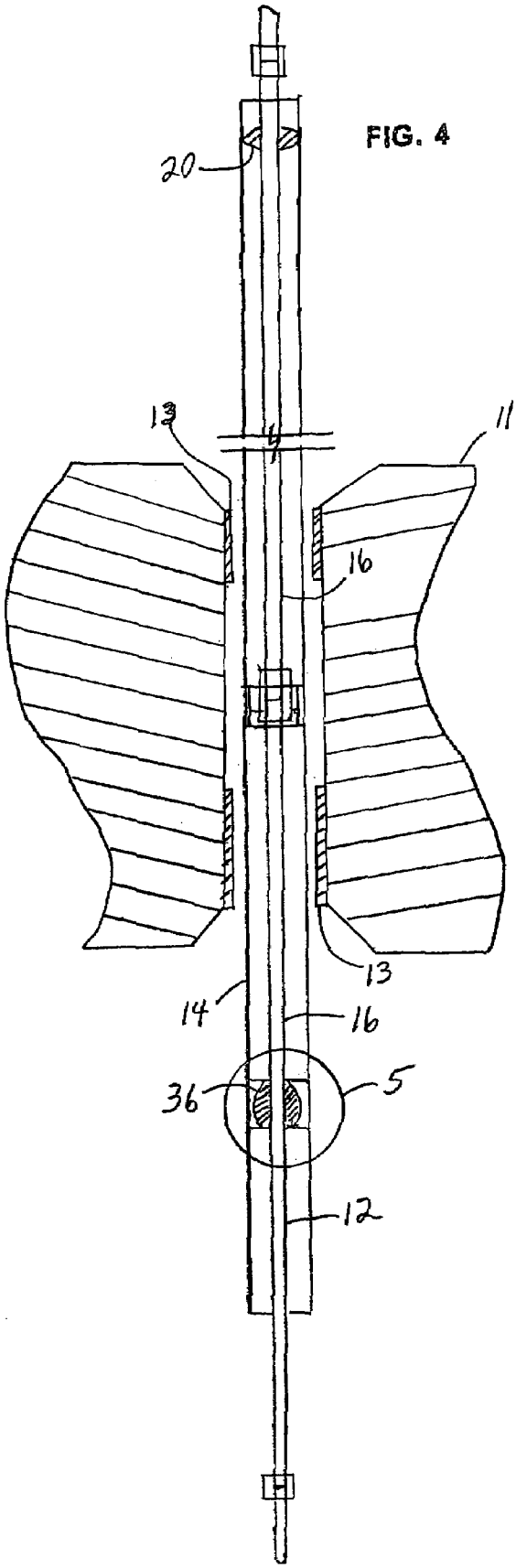
FIG. 4 is an elevation view of an alternate embodiment of the invention.
Figure 5:
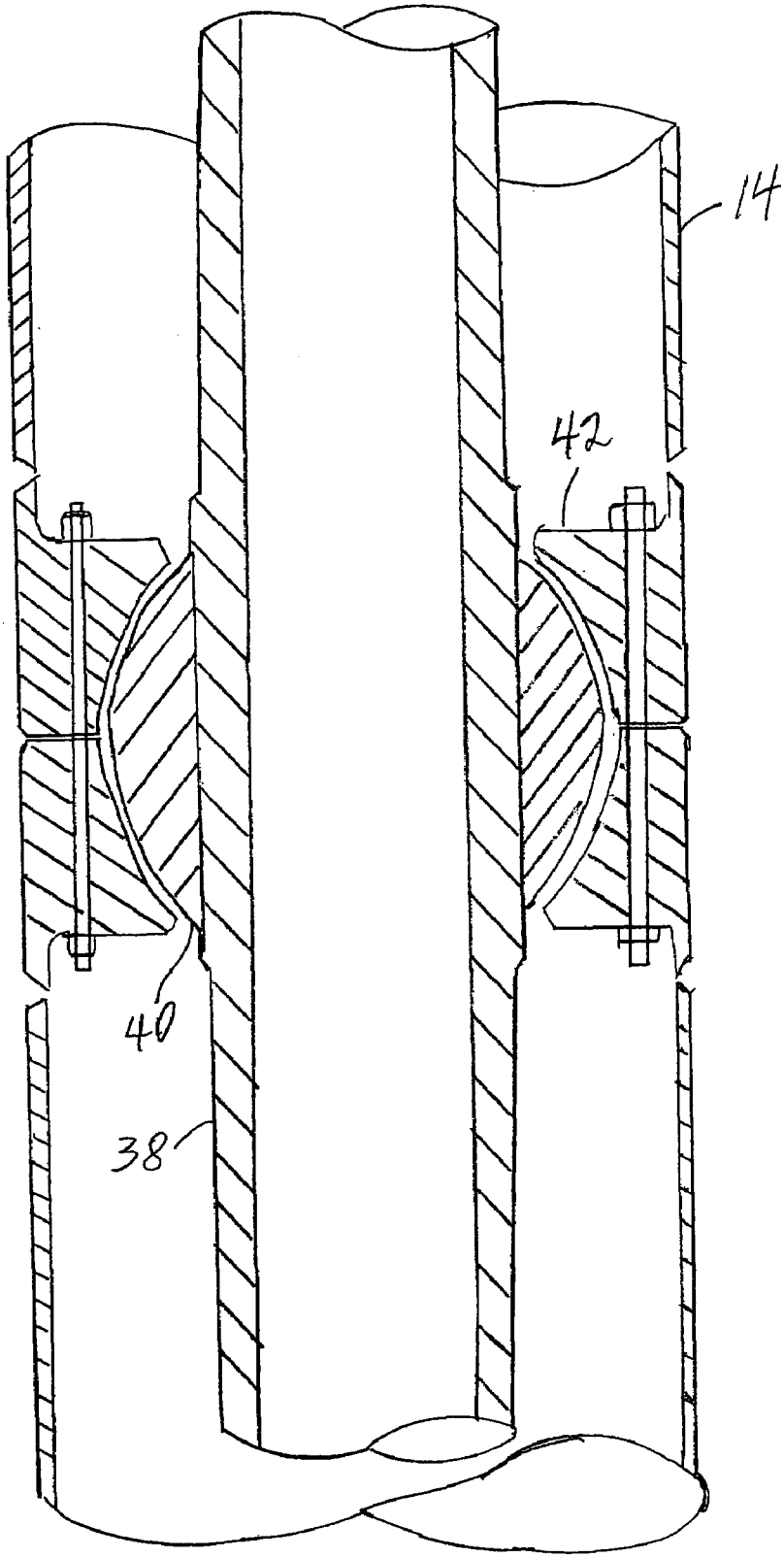
FIG. 5 is a detailed view of the circle area indicated by the number 5 in FIG. 4.

FIG. 4 and 5 illustrate an alternate embodiment of the invention that uses a compliant ball mechanism 36 between the riser joints and the sleeve 14. A thick wall dual tapered riser section 38 with a keel ball 40 attached is received in ball socket 42. The compliant ball mechanism is preferably moved up from the lower end of the sleeve 14. The ball socket 42 is formed by clamping together the two halves using pre-tension bolts and then rigidly attaching the mechanism to the sleeve 14 by any suitable method such as welding. The smooth contact between keel ball 40 and ball socket 42 allows for the desired relative rotation between the riser 38 and the sleeve 14. The internal riser and sleeve below the compliant ball mechanism are pre-assembled in the shop before transfer to the offshore installation. This embodiment provides more flexibility than the embodiment of FIG. 1 and 2.

The bottom of the sleeve 14 is preferably positioned approximately twenty feet below the bottom of the keel of the offshore structure 11. As seen from the description and drawings, the connection between the sleeve and riser causes them to act as one unit moving up and down in the keel of the offshore structure as the riser moves up and down relative to the structure in response to the environmental motions of the structure. The invention provides a flexible mechanical assembly with adequate strength and friendly fatigue resistant details for high stroke demand top-tensioned riser arrangements.

The invention provides numerous advantages over the known art.

The arrangement of the invention provides a flexible mechanical assembly with adequate strength and friendly fatigue resistant details for a high stroke demand top-tensioned riser arrangement.

A problem solved by the invention is to provide a compliant assembly to accommodate the relative pitch and stroke between the riser system and hull structure. This is accomplished by adding a tapered riser joint to the lower part of a long piece of outer sleeve bushing in the hull keel structure. It should be understood that the position of the bottom end sleeve below the hull keel structure is important for this invention and this is controlled by the length of the sleeve that is used. The result is an extension of the fatigue life of the system by providing sufficient flexibility in the keel joint assembly in a manner that is lower in cost than the prior art.

Another problem solved by the invention is to provide three types of mechanical interfaces as an attachment point for the lower tapered riser joint and upper riser joint inside the sleeve to the stem sleeve. The interface can be either rigid moment connection or ball type pin connection. This configuration has a wide application from relatively shallow water to ultra-deep water.

The invention provides a significant reduction in the time, cost, and risk offshore to install the can and keel joint system. By adding a sliding keel sleeve to the riser system at the keel region instead of the conventional way of adding a long stem hanging from the buoyancy can, the suspended load on the buoyancy can is lessened and the can does not have to be attached to the sleeve in the field.

Another advantage is that the sliding keel sleeve can be run using a drilling rig in the normal course of running the risers. The overall length of the keel joint assembly of the invention is approximately ninety feet. However, the pre-assembled length of each joint is not more than sixty feet, which is less than the general installation joint length limits of the drilling rig. A mechanical connector is used to make up the two lengths of sleeve that constitute the full joint. Therefore, no special installation equipment is required to install the keel joint assembly of the invention.

Another advantage is that a large stroke is allowed in this invention. The total stroke can reach to a large magnitude up to sixty feet. This amount of stroke covers a wide stroke range of the Spar top-tensioned riser from 2,000 to 10,000 foot water depth.

Another advantage is that the preferred embodiment of the invention has only a single tapered riser joint. Compared to the conventional design of a dual tapered riser joint, it cuts the length and volume of the forged, machined, tapered pieces by half. Significant material and machining work is reduced.

Another advantage is that the invention maximizes the utilization of the standard API 6A connectors and profiles. This off-the-shelf flange technology minimizes the application risk while simplifying the design and testing procedures required.

As in all keel joints, the maximum bending moment occurs when the offshore structure is in its maximum laterally offset position because this is also the time when the points of load transfer between the riser and the keel joint are at the maximum distance below the keel guide, thus creating the largest distance between the lateral force and the guides resisting the lateral force (the largest bending moment in the keel joint). In this invention, when the riser is in this maximum downward position, the keel joint sleeve is at its most flexible and thus best able to draw bending moment away from the riser pipe itself. When the keel is minimally offset, the keel joint sleeve is at its stiffest position but the bending moments on the riser are the smallest so this stiffness is acceptable.

The invention introduces:

elimination of the need for a stem section from the keel to the buoyancy can. Normally, this means two hundred fifty to three hundred feet of stem is eliminated on each riser.

elimination of the weight of these long stem sections on the buoyancy cans.

two levels of guides to provide moment resistance for the sleeve section.

joint construction almost entirely from off-the-shelf items.

a simple bolted connection using standard flanges that can be readily made up in the field.

elimination of the special tapered, heavy wall section of riser above the riser-sleeve connection (the section of riser inside the sleeve).

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. In a floating offshore structure having a top-tensioned riser arrangement, a compliant riser keel joint assembly, comprising:

a. an outer sleeve positioned inside two keel guides in the hull structure;

b. an internal riser joint positioned in said sleeve and having a flange attached at the lower end;

c. a centralizer mounted inside said outer sleeve adjacent the upper end and sized to receive said internal riser joint;

d. a single, tapered riser joint positioned below said internal riser joint; and e. means for connecting the lower end of said internal riser joint to the upper end of said single-tapered riser joint, comprising i. said internal riser joint having a threaded lower end;

ii. a flange attached to the upper end of said tapered riser joint; and iii. a machined ring attached to said sleeve, said ring having a threaded bore sized to threadably receive the internal riser joint and providing the attachment point for the flange on the tapered riser joint.

2. The riser keel joint assembly of claim 1, wherein said sleeve extends approximately twenty feet below the lower end of the hull keel structure.

3. In a floating offshore structure having a top-tensioned riser arrangement, a compliant riser keel joint assembly, comprising:

a. an outer sleeve positioned inside two keel guides in the hull structure;

b. an internal riser joint positioned in said sleeve and having a flange attached at the lower end;

c. a centralizer mounted inside said outer sleeve adjacent the upper end and sized to receive said internal riser joint;

d. a single, tapered riser joint positioned below said internal riser joint; and e. means for connecting the lower end of said internal riser joint to the upper end of said single-tapered riser joint. comprising;

i. a flange attached to the lower end of said internal riser joint;

ii. a flange attached to the upper end of said tapered riser joint; and iii. a machined ring attached to the sleeve, said ring providing the attachment point for attaching the flanges on said riser joints to the ring.

* * * * *